US005307655A

United States Patent [19]

Boltz et al.

[11] Patent Number: 5,307,655

[45] Date of Patent: May 3, 1994

[54] TIMED TRIGGERING CONTROL DEVICE FOR A MECHANISM

[75] Inventors: Jean-Henri Boltz, Neuchatel; Jean-Luc Monnier, La-Chaux-de-Fonds; Pierre-André Sermet, Marin, all of Switzerland

[73] Assignee: Ciposa Microtechniques S.A., Switzerland

[21] Appl. No.: 807,867

[22] PCT Filed: May 10, 1991

[86] PCT No.: PCT/CH91/00111

§ 371 Date: Jan. 13, 1992

§ 102(e) Date: Jan. 13, 1992

[87] PCT Pub. No.: WO91/18168

PCT Pub. Date: Nov. 28, 1991

[30] Foreign Application Priority Data

May 14, 1990 [FR] France ..... 90 06149

[51] Int. Cl.[5] ..... E05B 43/00

[52] U.S. Cl. ..... 70/271; 70/267

[58] Field of Search ..... 70/267-274

[56] References Cited

U.S. PATENT DOCUMENTS

| | | | |
|---|---|---|---|
| 590,927 | 9/1897 | Williams | 70/274 |
| 688,119 | 12/1901 | Rees | 70/271 |
| 3,145,271 | 8/1964 | Johnson | 70/271 |
| 3,340,710 | 9/1967 | O'Brien | 70/271 |
| 3,881,171 | 4/1975 | Moorman | 70/271 X |
| 3,950,678 | 4/1976 | Brewer | 70/271 X |
| 4,232,613 | 11/1980 | Kempf | 109/40 |
| 4,944,170 | 7/1990 | Jolidon et al. | 70/274 X |

FOREIGN PATENT DOCUMENTS

| | | | |
|---|---|---|---|
| 132600 | 7/1902 | Fed. Rep. of Germany | 70/271 |
| WO89/03922 | 5/1989 | PCT Int'l Appl. . | |
| 2142374 | 1/1985 | United Kingdom | 70/271 |

*Primary Examiner*—Lloyd A. Gall

*Attorney, Agent, or Firm*—Davis, Bujold & Streck

[57] ABSTRACT

The device includes at least one sliding bolt in a disengaging mechanism, and at least one movable pin arranged to lock said disengaging mechanism and prevent movement of the bolt. It is mounted in a housing (10) and consists of two identical control modules (11, 12) each having an arm (**11*a*, 12*a*) which is fast on a lever (13) controlling the movable locking pin (14). Each module is mounted on a base plate (11*b*, 12*b*) supporting a mechanical activating device (11*c*, 12*c*) and a device for controlling this device and pushing the arm (11*a*, 12*a*) by means of a detent pin (11*d*, 12*d*). The activating device comprises at least one potential energy storage element while the module comprises a device for arming this element. A programmable electronic timing device and a member coupled thereto are provided for releasing the potential energy at a predetermined time. Each module has an independent power supply from cells or batteries (11*e*, 12*e*). A display device (11*f*, 12*f***) provides control parameter display.

16 Claims, 7 Drawing Sheets

TIMED TRIGGERING CONTROL DEVICE FOR A MECHANISM

The present invention concerns a device for controlling timed triggering of a mechanism, particularly for unlocking a vault lock, consisting of at least one sliding bolt in a disengaging mechanism and at least one movable locking pin designed to unlock the disengaging mechanism and prevent displacement of the bolt, said movable locking pin being coupled with a mechanical activating device associated with a control module, in which the mechanical activating device comprises at least one element for storing potential energy, the control module having means for arming said element.

BACKGROUND OF THE INVENTION

Various devices of this type for equipping safes, vaults, or doors of protected sites are already known.

The timed control device for opening a lock described in international application published as No. W089/03922 comprises a locking mechanism controlled by an electronic device with a triggering module and a blocking module. The locking mechanism is designed to block a bolt in locked position for a predetermined time period defined by the electronic control device.

These known conventional mechanisms generally have a spring barrel and a timing mechanism with an escape device which frees the energy in a previously armed spring barrel at a moment previously defined by the timing mechanism and disengages a peg associated with a locking pin.

These timing mechanisms have the disadvantage of being very costly because the mechanical parts must be extremely precise. Furthermore, the controls which can be exerted on this type of mechanism are limited to those which can be exerted on a mechanical watch movement, in known manner.

SUMMARY OF THE INVENTION

The present invention proposes overcoming the disadvantages described above by achieving a device of conventional appearance using the energy stored by a spring mechanism to unlock a locking pin, while also providing more effective, more precise and more reliable controls than those presently used.

To achieve this, the device according to the invention is characterized in that it has programmable electronic timing means and a device associated with this means to free said potential energy at a predetermined moment defined by this programmable electronic timing means.

According to a preferred embodiment the means for storing said potential energy is a spring mechanism which generates mechanical force.

Said means for freeing the potential energy advantageously consists of a locking cam.

Preferably, said locking cam consists of a pivoting element disposed to engage in at least one peripheral notch in a locking disc, said locking disc being coupled to the axle of the spring generating mechanical force. They are coupled by means of toothed wheels.

According to an advantageous embodiment, the locking cam is attached to an output shaft on an electric motor. The electric motor is preferably an oscillating type motor.

In the preferred embodiment, the device for freeing said potential energy further consists of a wheel with a click, a click mounted on said wheel, a ratchet concentric with said wheel and engaging said click, and a drive wheel connected to said wheels, the wheel with the click, the ratchet and the drive wheel being mounted on the axle of the spring generating mechanical force.

The click wheel advantageously has a catch designed to cooperate with a lever pivoting on an axle which moves a positioning disc into the appropriate locking position in relation to the locking cam.

In this form of embodiment, the means for arming the potential energy storage element consists of a key shaft coupled with a drive pinion supporting an arming click, said click being designed to cooperate with a set peg supported by a set wheel, said wheel being integral with the axle of the spring generating mechanical force.

Preferably, the drive pinion is integral with a pinion engaging a release rake with a triggering peg disposed to act on the movable locking pin of a lock, and said set wheel engages a contact disc, said wheel being associated with a programming disc to provide a startup signal to the electronic timing elements and to control the timed duration.

Said electronic timing elements are advantageously designed to control the element driving the locking cam when it receives the startup signal. They can also be designed to perform a function test at the time of startup.

According to another form of embodiment, the device has at least two control modules and means interconnecting these two modules.

Advantageously, the timing elements can be programmed with a key.

When the timing elements are programmed with a key, the key is dsesigned for programming the timing elements simultaneously with arming the spring which generates mechanical force.

BRIEF DESCRIPTION OF THE DRAWINGS

The present invention will be better understood with reference to the description of one preferred embodiment of the device according to the invention and to the attached drawing, wherein.

DESCRIPTION OF THE PREFERRED EMBODIMENTS

The locking principle in this type of control device for a security lock is as follows: a locking pin or bolt is blocked by a mechanical part such as a movable blocking pin which can be retracted to free the first pin by means of a watch type mechanism. Since it is necessary to release a certain potential energy to retract the movable blocking pin, the device has at least one spring, for example a spring mechanism, to activate a lever connected with the movable pin.

Figure 1:
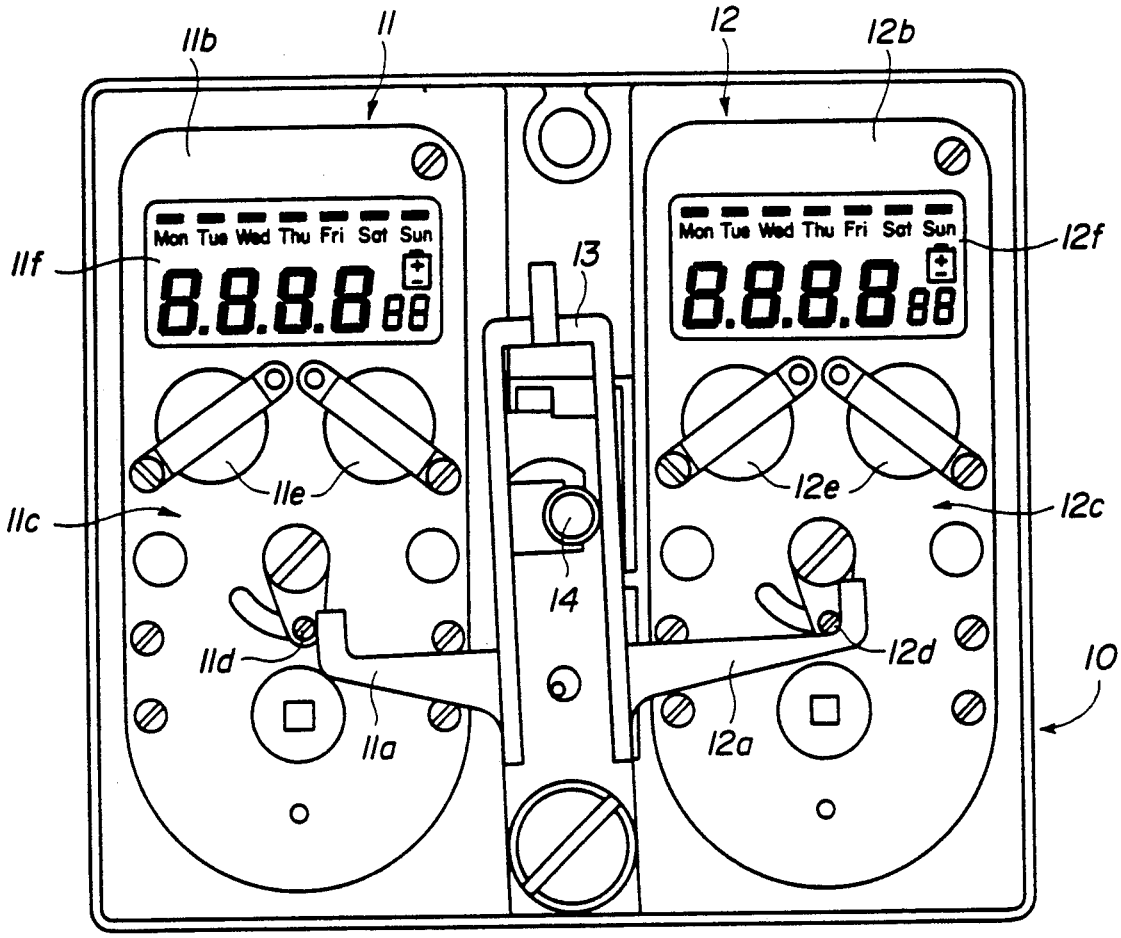
FIG. 1 shows a view of the entire device according to the invention housed inside a safe.

In the embodiment shown in FIG. 1, the device is shown in a housing 10 and consists of two identical modules 11 and 12 each with an arm 11*a*, 12*a*, respectively, integral with a lever 13 controlling the pivotable locking shaft 14 designed to block the bolt and prevent it from sliding axially.

Each of the modules 11, 12 is mounted on a base plate 11*b*, 12*b*, respectively, which has a mechanical activating device 11*c*, 12*c*, respectively, and means for controlling said device which pushes arm 11*a*, 12*a*, respectively, by means of a detent pin 11*d*, 12*d*, respectively.

The control device according to the invention may consist of only one, or two or more modules, such as modules 11 and 12. In the remainder of this text, only module 11 will be described, it being understood that all its components are present in the other identical modules 12, etc., when the device corresponds to that illustrated in FIG. 1 or to other embodiments with three modules, etc. The device operates perfectly with only one module 11 or 12, but is obviously more reliable if it has two or more identical modules 11 and 12. In addition, the two modules are designed to communicate with each other by means of electrical, optic or magnetic connection, for example. Each module is independently supplied, for example, with two batteries or storage cells 11*e* and 12*e*, respectively. They also have a display device, for example a liquid crystal type display 11*f* and 12*f*.

Figure 2A:
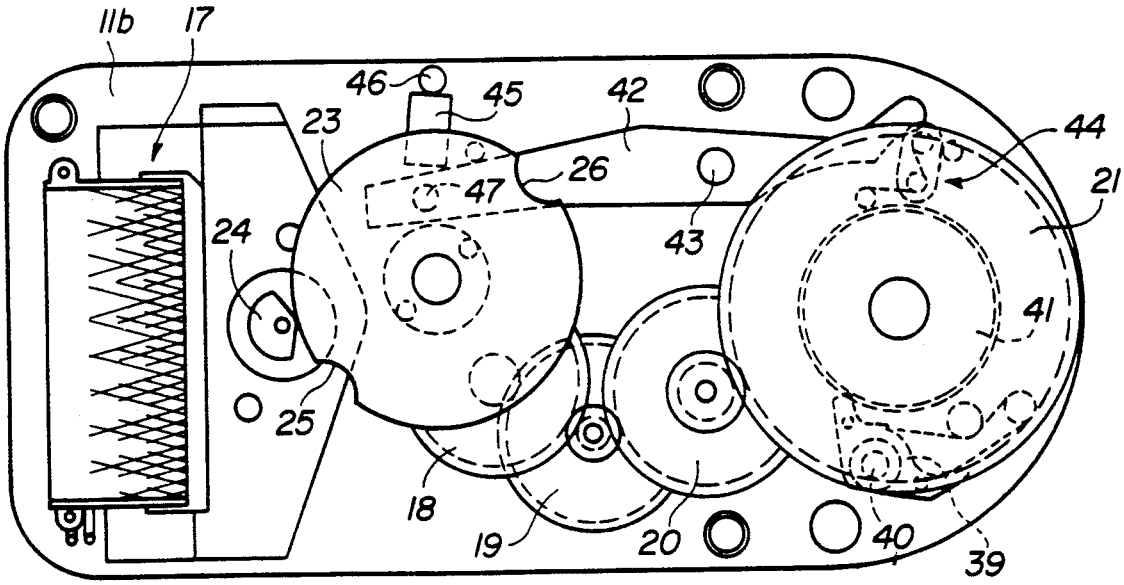
FIG. 2A shows a top view of the lower portion of the device according to the invention.
Figure 2B:
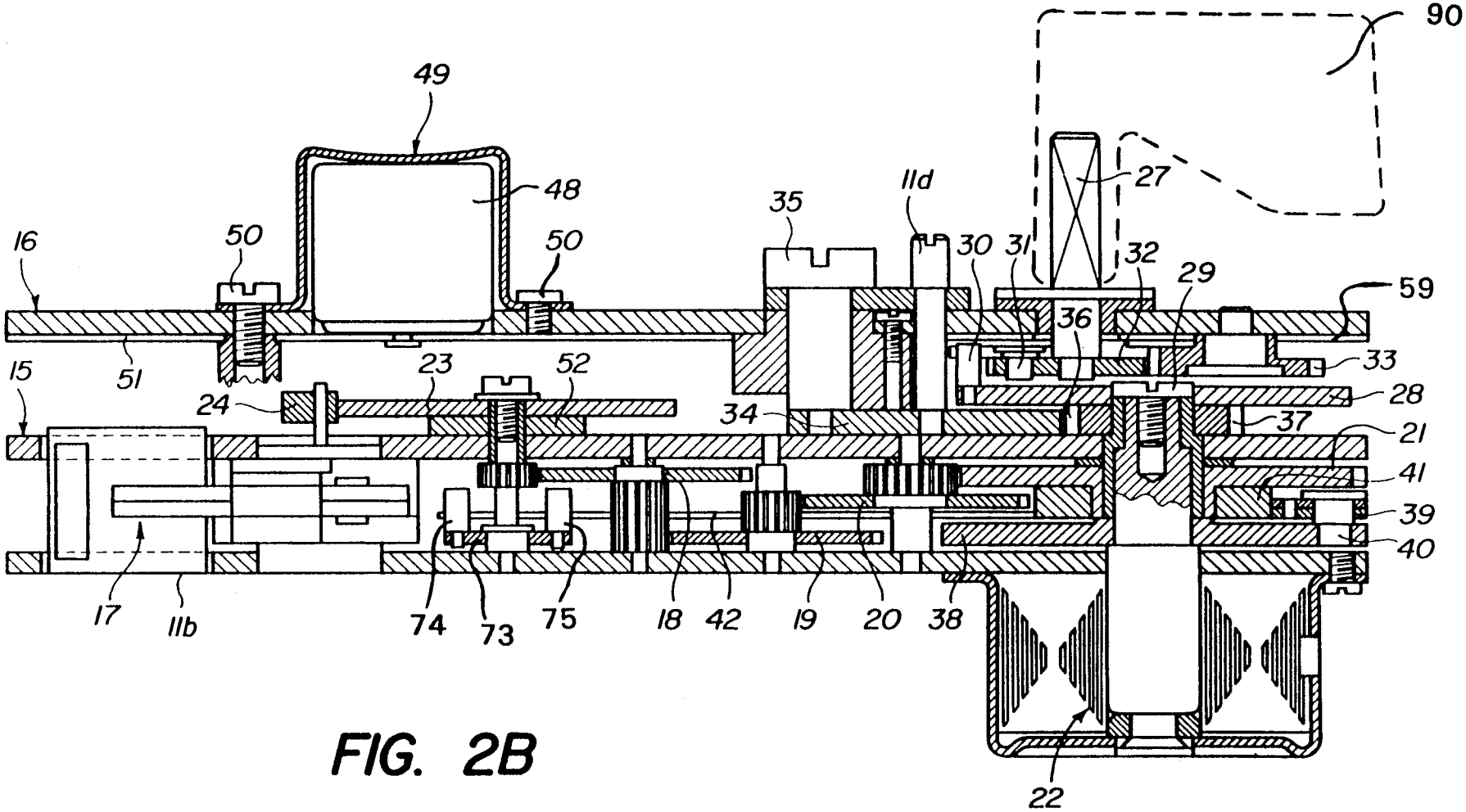
FIG. 2B is an axial cross-section of the device according to the invention.

With reference to FIGS. 2A and 2B, the module shown comprises base plate 11*b* serving as a base for attaching all the components. An intermediate bridge 15 and an upper bridge 16, which are plates parallel to base plate 11*b*, also serve as supporting structures for the components. An electric motor 17, for example, an oscillation type (step) motor, or any other drive means such as, for example, an electromagnet, etc., is attached between base plate 11*b* and intermediate bridge 15. The same is true for a group of wheels (gears) 18, 19, 20 coupling a drive wheel (gears) 21 mounted on the axis of a spring mechanism 22 generating mechanical force, a locking disc 23 cooperating with a locking cam 24 mounted on the output shaft of electric motor 17. This locking cam is crescent-shaped and turns about an axis which is the axle of the output shaft of electric motor 17. Locking disc 23 has at least one peripheral notch 25. In the embodiment shown this disc comprises two notches 25 and 26 designed to cooperate with the locking cam 24 in a way that will be explained below. These notches are diametrically opposed and circular in shape, with a diameter corresponding to that of the locking cam. These various components are located between base plate 11*b* and intermediate bridge 15.

On upper plate 16 there is mounted a key shaft 27 indirectly coupled with a set wheel 28 attached by means of a bolt 29 to the end of the axle of spring mechanism 22. This connection is made by means of a set pin 30 integral with set wheel 28 and a set click 31 held by drive pinion 32 attached to the end of key shaft 27. A contact disc 33, mounted below upper bridge 16, engages drive pinion 32.

The detent pin 11*d* mentioned above is held by a part called the release rake 34, pivoting about an axle 35 also mounted on upper bridge 16. This release rake 34 has, at the end opposite its axis of rotation 35, a serrated portion 36 engaging a pinion 37 integral with the axle of spring mechanism 22.

The axle of the spring mechanism also has a click wheel (gear) 38 parallel to the drive wheel 21 on which there is mounted a click 39 pivoting on an axis 40 integral with said click wheel. Click 39 engages a ratchet 41, which is itself integral with drive wheel 21 described above.

A lever 42 pivoting around an axle 43 cooperates with a lever-pushing catch 44 mounted on click wheel 38. A recall spring 45, one end of which is affixed to a fixed pin 46 mounted on base plate 11*b* and the other end to a pin 47 affixed to lever 42, tends to urge this lever against pushing element 44.

Upper bridge 16 also has one or more cells or batteries 48 attached with clamps 49 and screws 50, as well as programmable electronic timing means 51 supplied with electricity by cells or batteries 48.

A mechanical brake 52 in the form of a friction disc is mounted on intermediate bridge 15 beneath locking disc 23 to stabilize it.

The device described above functions as follows: the spring mechanism which could also be replaced by any other spring capable of storing the potential energy necessary to activate lever 13 and rotate locking shaft 14, is preconstrained. Its useful course is limited by the fact that the triggering phase per se corresponds to rotation of the drive wheel at an angle of the order of 120° for the embodiment shown.

Figure 3B:
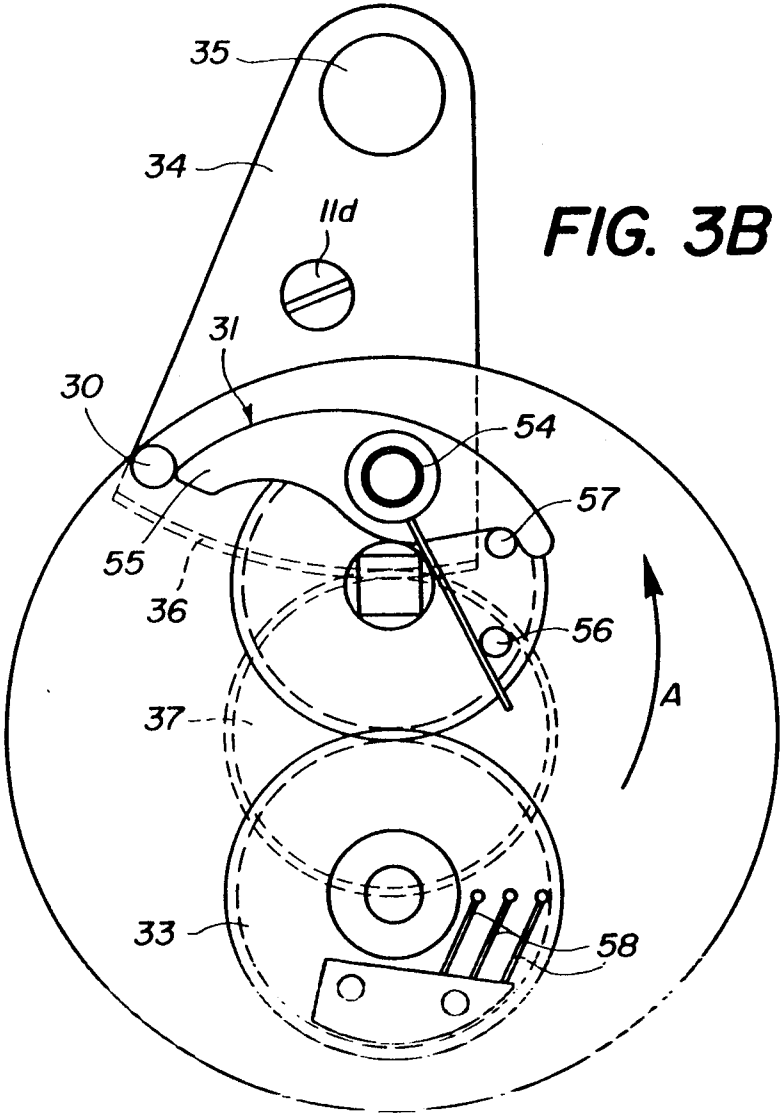
FIG. 3B is a view similar to that of FIG. 3A with the device in armed position.
Figure 3A:
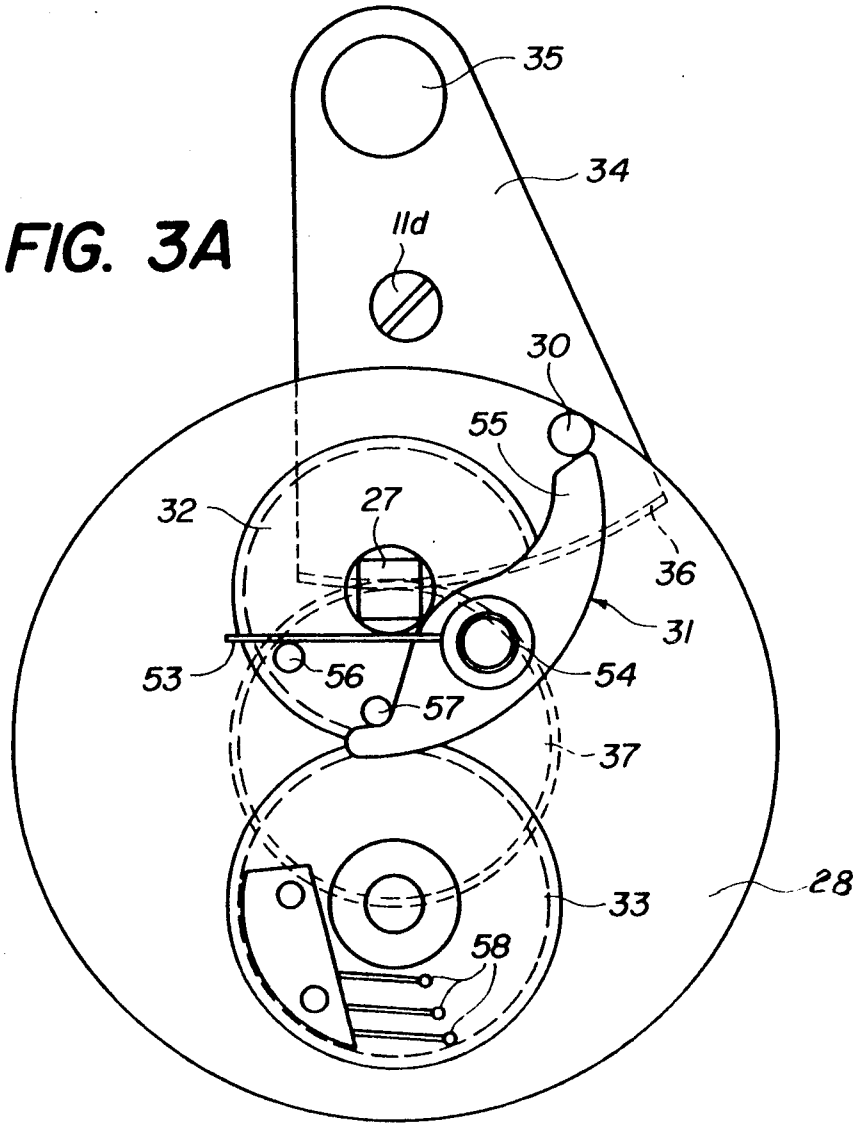
FIG. 3A shows a partial view of the device, particularly the portion of the device for arming the spring which generates mechanical force and for setting the time, in resting position.

The portion of the device which corresponds to arming spring mechanism 22 is shown in resting position in FIG. 3A and in armed position in FIG. 3B. In FIG. 3A, set click 31 is in contact with set pin 30. A spring 53 mounted on the axis of rotation 54 of said click tends to push the arming tip 55 of the click toward the outside, that is, toward the periphery of set wheel 28 with set pin 30. This spring is preferably a plate designed to contact fixed pin 56. A pin 57, which, like pin 56, is held by drive pinion 32, serves to block click 31 in the arming phase. Contact disc 33 has contact plates 58, for example three in number, which are designed to cooperate with a programming disc 59 (FIG. 2B) mounted on the electronic timing circuit means 51.

When the operator turns the key 90 shown in FIG. 2B after having previously engaged it on shaft 27, it drives drive pinion 32 counterclockwise as shown by arrow A in FIG. 3B. Click 31 drives set pin 30 and engenders rotation of set wheel 28 and consequently, the axle of spring mechanism 22. Given the divergence of the trajectories followed by arming tip 55 of click 31 and by the set pin, there comes a point, after rotation of the order of 120°, where the click no longer drives the pin. The device is armed and the key 90 can turn freely on the mechanism without effort. This point, which corresponds to the end of arming the device, is important for the entire functioning of the device, as will be explained hereinafter.

Pinion 37, which engages release rake 34, causes the latter to pivot around its axis 35 and places the set pin in the armed position shown in FIG. 3B. Drive pinion 32 also drives contact disc 33 which, when the end point of arming is almost reached, furnishes a startup signal to the electronic control means. This signal alerts the electronic unit and positions it for regulating timing. Note that the electronic unit is designed so that it starts up after a function test verifying that the batteries, the peripheral circuits, etc. are in working condition. If they are deficient, start up cannot take place. This constitutes an important safeguard. Regulation takes place with the key 90 which drives drive pinion 32 and contact disc 33. As mentioned before this disc cooperates with a programming or code disc for controlling timing. The device can work in at least two ways, as follows: in one method a duration of time (t) is selected and displayed corresponding to the time interval between the present moment and the time the lock will be opened. In the other method, a date and hour for opening the lock are displayed, without regard for the interval of time from the present moment. Coding may be designed, for example, so that one clockwise rotation effects increments in hours and minutes, and one rotation in the other direction effects a decrease. Rotating the key 90 slowly might display minutes, while rapid rotation would display hours.

Figure 4B:
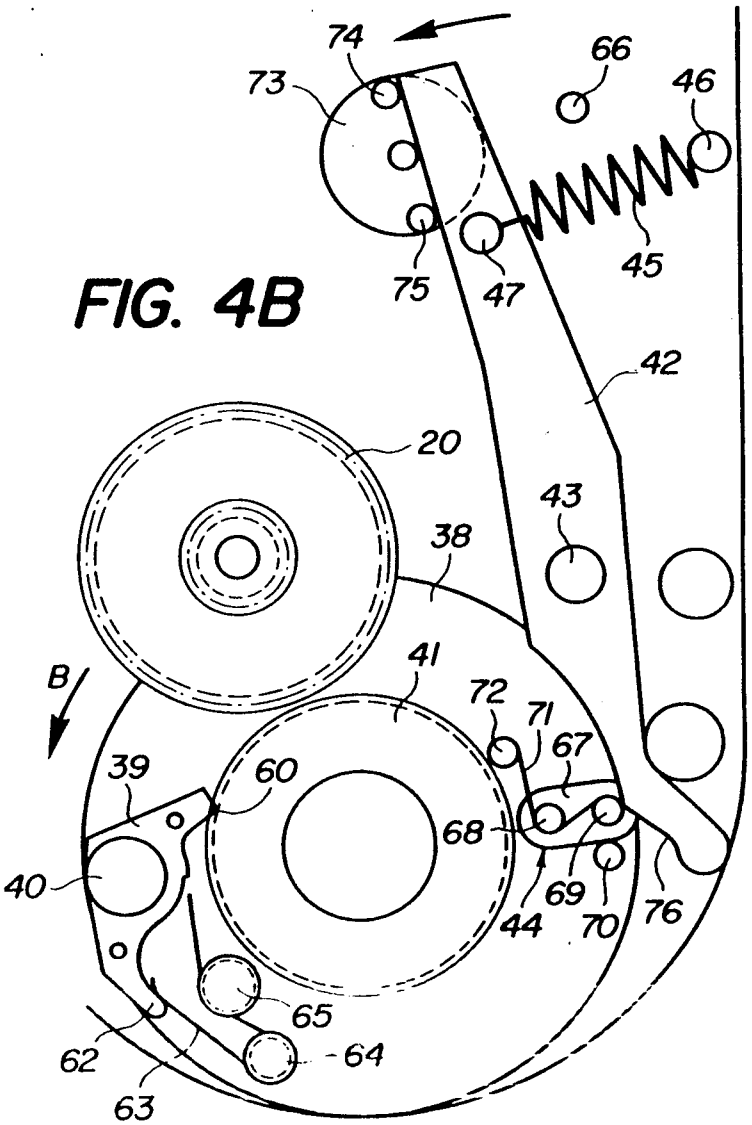
FIGS. 4A, 4B, 4C and 4D are four similar views illustrating a portion of the device designed to lock the kinematic chain transmitting energy stored in the spring in resting position, in the beginning of the locking position, in the end of the locking position, and in the triggering position, respectively.
Figure 4A:
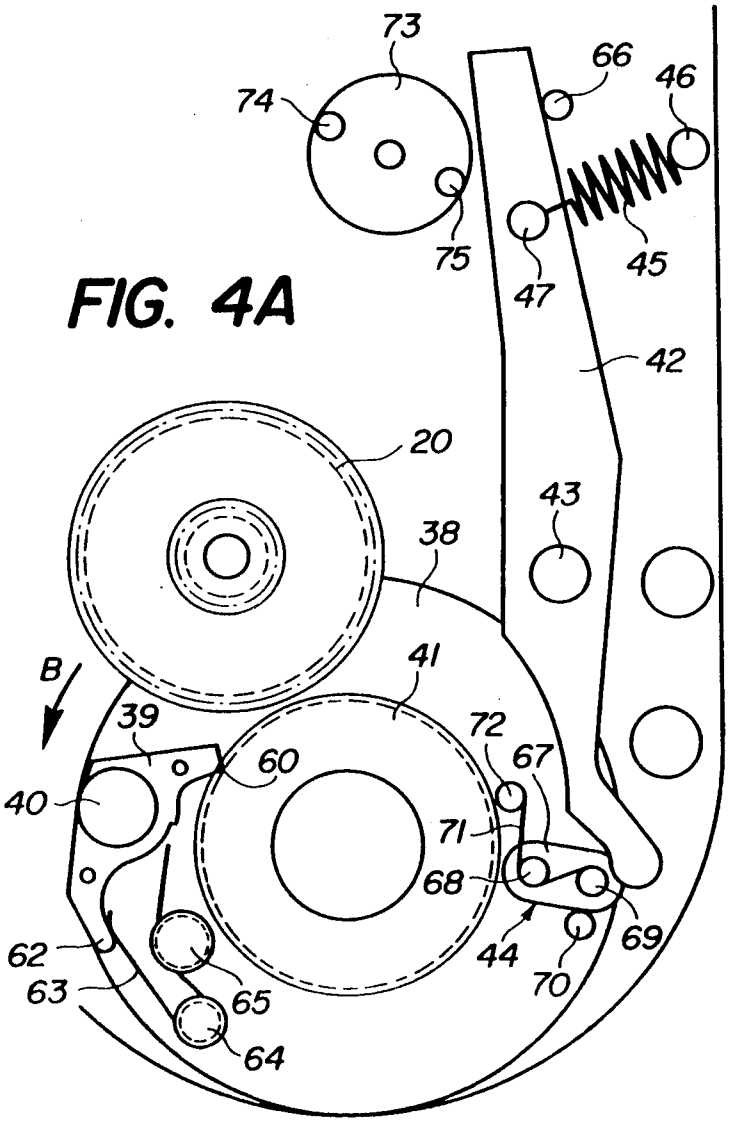

The arming action, set in motion by rotating the key, also has the effect of turning click wheel 38 in counterclockwise direction as shown by arrow B in FIG. 4A, which corresponds to resting position, that is, the position assumed by the components shown before rotating the key.

At tip 60 click 39 is engaged with the teeth of ratchet 41, integral with the click wheel. Click 39 comprises a point 62 in contact with a spring 63 which tends to push tip 60 toward ratchet 41. This spring 63 consists of a plate rolled around two cylindrical pins 64 and 65 mounted on click wheel 38.

Lever 42 is pulled into contact with stop 66 by spring 45. The element pushing lever 44 actually consists of a flat piece 67 pivoting around an axle 68 and holding a stop 69. Flat piece 67 is in contact with a block stop 70 supported by click wheel 38 by virtue of the action of a spring 71 contacting on one side, stop 72 held by the click wheel an on the other side, stop 69 integral with this flat piece.

A positioning disc 73, mounted on the axle of locking disk 23, has two vertical shafts 74 and 75, diametrically opposed, designed to cooperate with lever 42.

FIG. 4B illustrates the beginning of the locking position and shows more particularly the parts of the device described with reference to FIG. 3A when the operator begins to turn the key.

In this position the click wheel 38 has turned on its axis in the direction of arrow B, the effect of which is to displace click 39 and flat piece 67 holding stop 69. This stop has activated lever 42, which has pivoted around its axis 43. The end of this lever has been placed in a position of contact with vertical shafts 74 and 75 of positioning disc 73. In this position, these shafts constitute block stops for lever 42. Actually, the lever has been brought into this position by virtue of the action of stop 69 on inclined portion 76 formed along the inside edge of the lever and stop block 70 disposed to retain the element pushing lever 44. When the positioning disc is in the position shown in this drawing, that is the locking position, locking disc 23 is in the position shown in FIG. 5B, which will be described later. In this position, the electronic timing elements transmit an impulse to the electric motor to move locking cam 24 inside one of the peripheral notches 25 or 26 on locking disc 23.

Figure 4D:
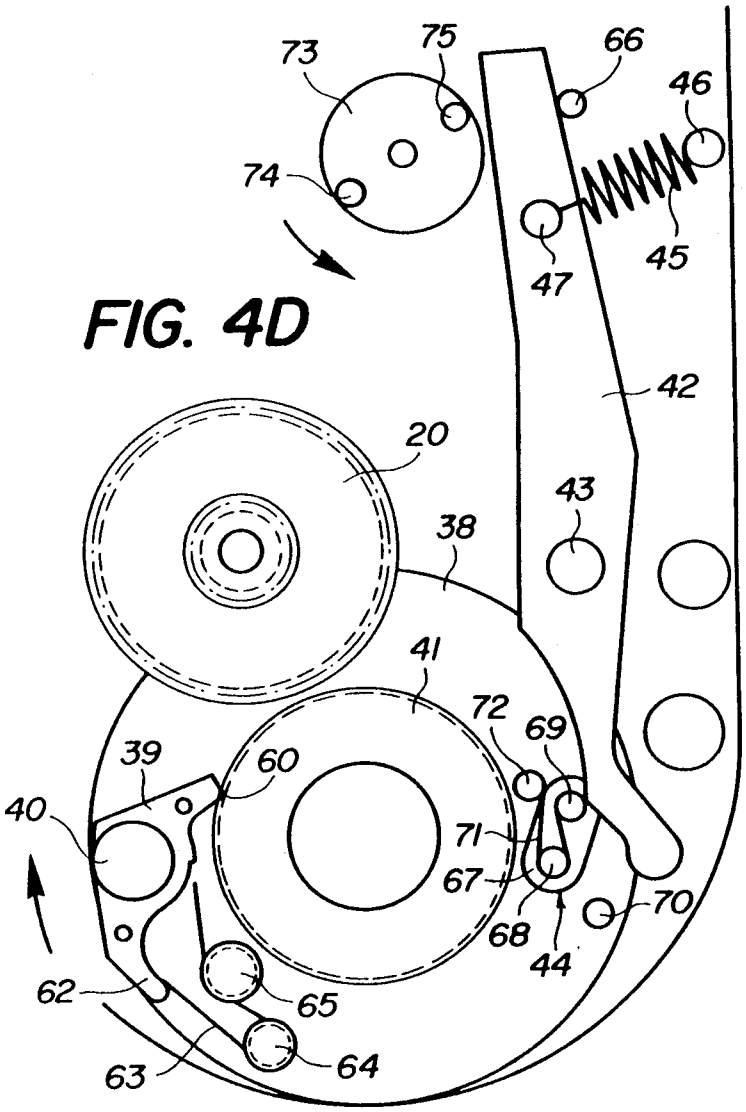
Figure 4C:
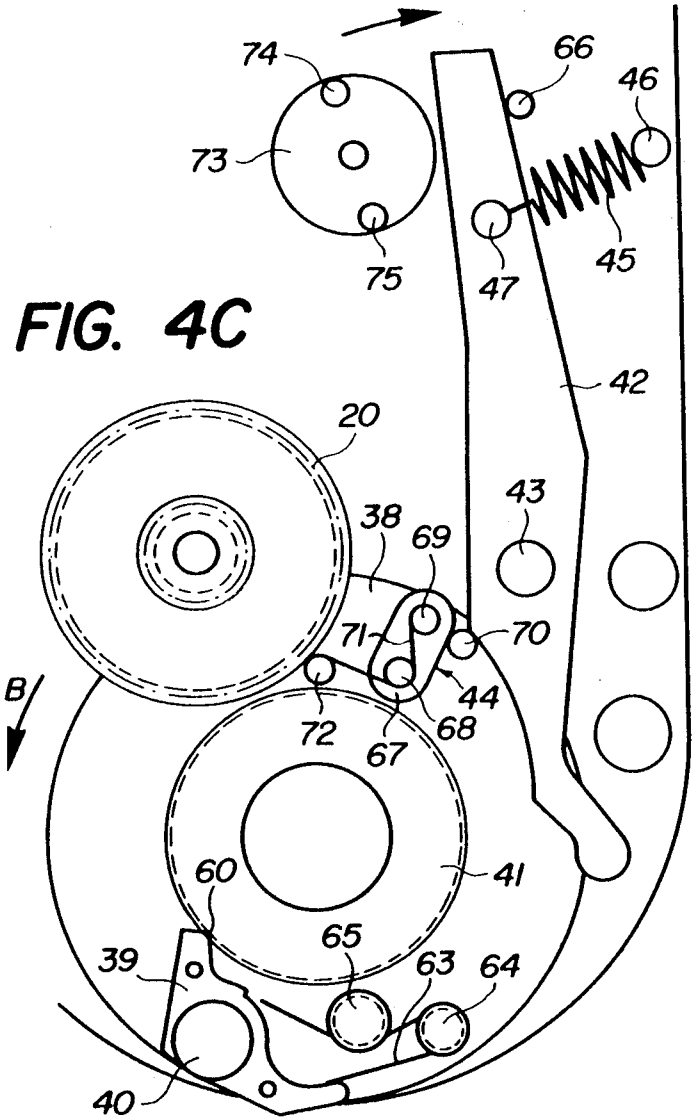

FIG. 4C shows the position at the end of the locking operation. Lever 42 has reverted to its initial position, but locking disc 23 still remains blocked by locking cam 24 so the potential energy of spring mechanism 22 cannot be released through the chain of gears consisting of wheels 18, 19 and 20.

FIG. 4D shows the components of 4A, 4B and 4C when in the disengaged position. Disengagement is controlled by locking cam 24 which is moved into the position shown in FIG. 5A when the set time period has elapsed. Locking disk 23 is freed, which has the effect of unblocking the chain of gears and consequently the axle of spring mechanism 22 by means of click wheel 38, click 39 and ratchet 41.

Given the fact that the recall force of spring 45 is greater than that of spring 71, the element pushing lever 44 rocks on its axis of rotation 68 and returns to its initial position shown in FIG. 4B. It is also because of this difference in spring forces that the mechanical activating device is able to revert to its initial position, which is the resting position, when the arming process is interrupted before the time setting phase.

Figure 5A:
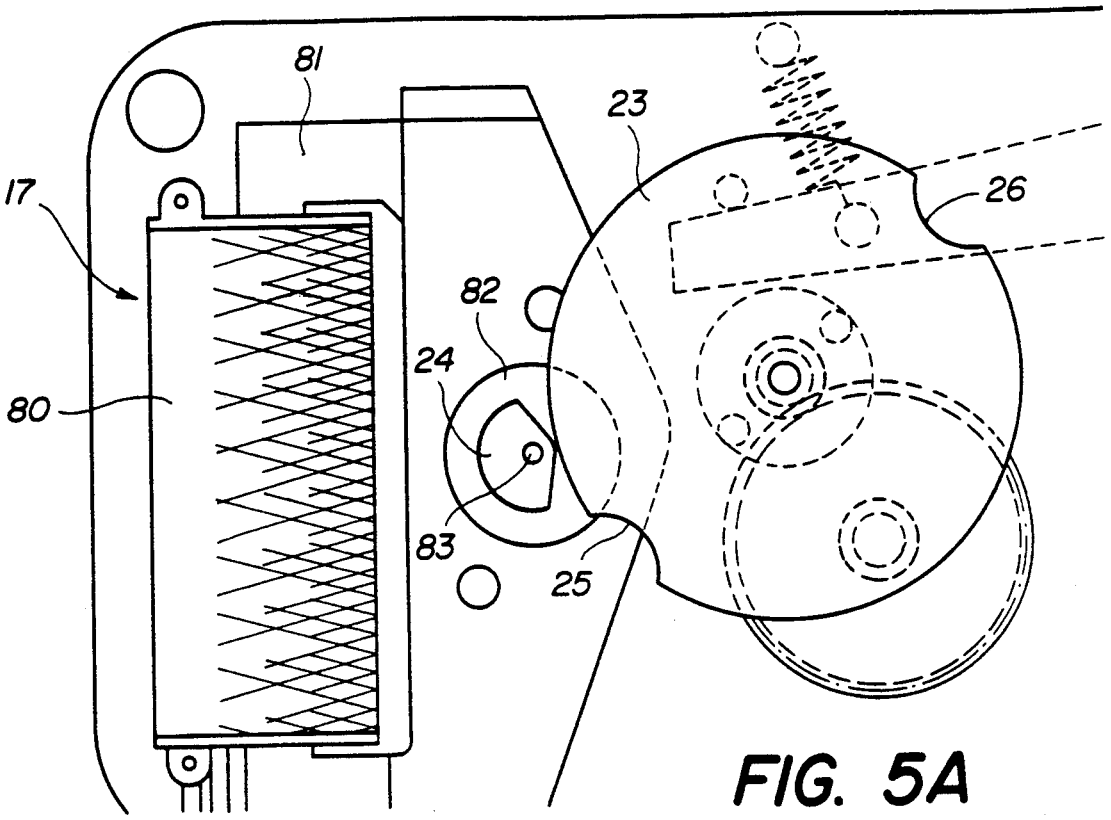
FIGS. 5A and 5B are partial views showing the parts of the lock which block and free the kinematic chain at rest and in locking position, respectively.
Figure 5B:
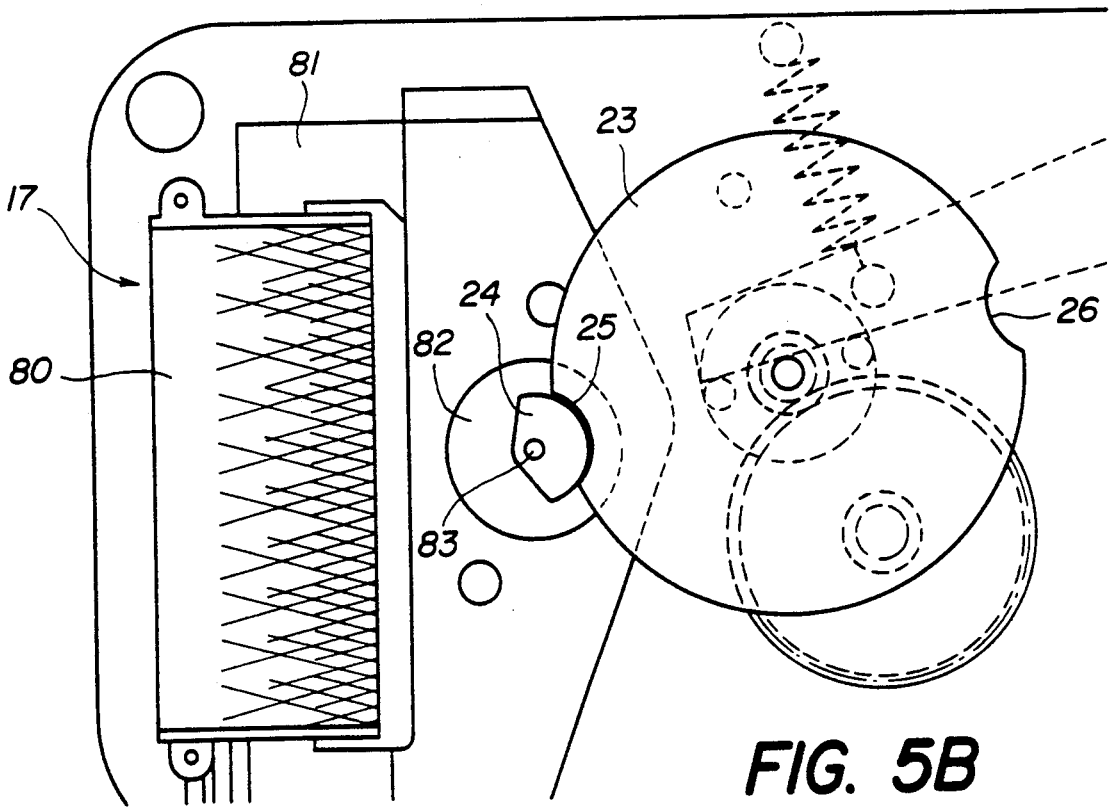
Figure 6:
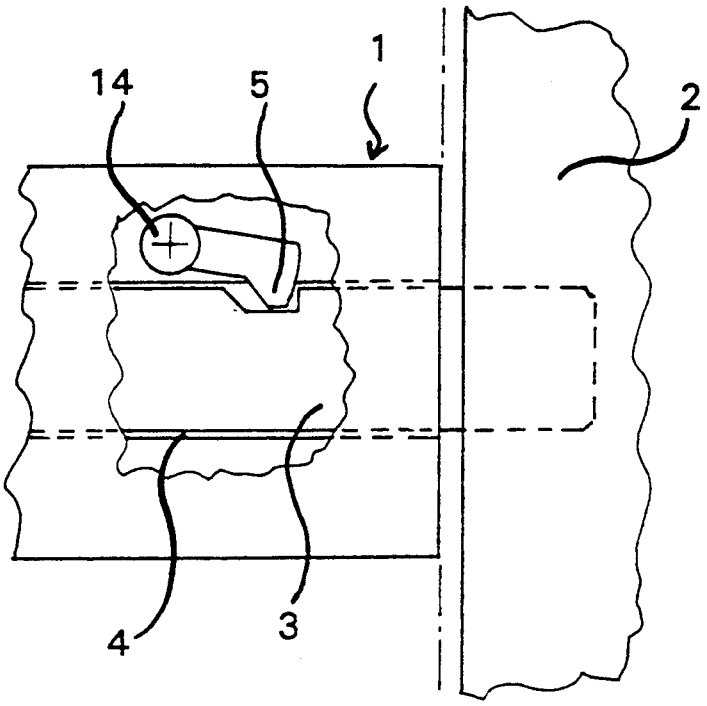
FIG. 6 is a partial cut away diagrammatic view of a security lock controlled by a triggering device according to the invention.

As previously mentioned, FIGS. 5A and 5B are detailed views of the components designed to ensure locking the control device in resting position and locking position, respectively. Electric motor 17 comprises a reel 80 mounted on a stator 81 and a rotor 82 with a drive shaft 83 to which locking cam 24 is attached. This cam has a partially circular shape, i.e., it is essentially crescent-shaped, which is designed to engage in notches 25 and 26 of locking disc 23. In the resting position illustrated in FIG. 5A, the locking disc occupies any position in which one of the notches 25 or 26 is not disposed across from this locking cam 24. When this disc is moved to the locking position, the contact disc 33 is in such a position that the electronic timing devices detect a locking order and transmit an impulse to oscillation motor 17 to cause locking cam 24 to rotate a half turn. When this cam engages in the corresponding notch, the locking disc is blocked, the effect of which is to block the entire kinematic chain up to spring mechanism 22.

When the set time period has elapsed, the timing elements transmit a control impulse to motor 17 which causes locking cam 24 to rotate a half turn, the effect of which is to release the potential energy in spring mechanism 22. To prevent the spring from expanding completely, the course of detent pin 11*d* is limited by the ends of an inwardly curved oblong opening formed in upper bridge 16.

The device may be adapted for remote control, for example, with the use of a transmitter-receiver. Remote control of the electronic components and of battery charging is also possible.

We claim:

1. A timed triggering device for a mechanism for unlocking a lock of a safe, the mechanism comprising a sliding bolt located in a channel for locking and unlocking the safe and at least one movable locking pin being engagable with the sliding bolt to prevent displacement thereof in the channel, the timed triggering device controlling movement of the movable locking pin and comprising at least one control module which includes:

a mechanical actuating device being coupled with the locking pin and having a spring mechanism for actuating the at least one movable locking pin and releasing the sliding bolt, arming means for mechanically arming the mechanical actuating device by storing potential energy in the spring mechanism, programmable electronic timing means for controlling a timed duration during which the timed triggering device prevents displacement of the sliding bolt, and a release device, being controlled by the programmable electronic timing means, for releasing the stored potential energy of the spring mechanism at a preselected time to disengage the at least one movable locking pin from the sliding bolt.

2. A timed triggering device according to claim 1, wherein the release device comprises a locking cam and locking and unlocking movement of the locking cam is controlled by the programmable electronic timing means.

3. A timed triggering device according to claim 2, wherein the locking cam consists of a shaped pivotable portion for engaging at least one peripheral notch in a locking disc, and the locking disc is coupled with a rotatable axle of the spring mechanism.

4. A timed triggering device according to claim 3, wherein the locking cam is mounted on an output shaft of an electric motor and movement of the electric motor is controlled by the programmable electronic timing means.

5. A timed triggering device according to claim 4, wherein the electric motor is a step motor.

6. A timed triggering device according to claim 3, wherein the locking disc is coupled with the rotatable axle of the spring mechanism by means of a series of toothed gears.

7. A timed triggering device according to claim 6, wherein the release device further comprises a click gear; a click mounted on the click gear; a ratchet disposed concentrically with the click gear and engaging the click; and a drive gear coupled with a gear of the series of toothed gears, and the click gear, the ratchet and the drive gear are mounted on the rotatable axle of the spring mechanism.

8. A timed triggering device according to claim 7, wherein the click gear has a pushing element cooperating with a lever which is pivotable about a lever axle, and the lever, when activated, moves a positioning disc into an appropriate locking position in relation to the locking cam.

9. A timed triggering device according to claim 8, wherein the drive gear is coupled with a pinion which engages a release rake having a detent pin disposed to act on the movable locking pin of the lock.

10. A timed triggering device according to claim 1, wherein the arming means comprises a key shaft coupled with a drive pinion supporting a set click, and the set click cooperates with a set pin supported by a set wheel, and the set wheel is supported by a rotatable axle of the spring mechanism.

11. A timed triggering device according to claim 10, wherein the drive pinion engages a rotary contact disc having electrical contacts which cooperate with a stationary programming disc to furnish a startup signal to the programmable electronic timing means and to control the timed duration during which the timed triggering device prevents displacement of the sliding bolt.

12. A timed triggering device according to claim 11, wherein the programmable electronic timing means controls movement of a drive element of the locking cam once the programmable electronic timing means receives the startup signal.

13. A timed triggering device according to claim 11, wherein the programmable electronic timing means performs a function test once the startup signal is received.

14. A timed triggering device according to claim 1, wherein the timed triggering device comprising at least two control modules with coupling means provided between the at least two control modules for controlling movement of the at least one movable locking pin.

15. A timed triggering device according to claim 1, wherein the programmable electronic timing means is programmable by actuation of a key.

16. A timed triggering device according to claim 15, wherein the key permits simultaneously programming of the programmable electronic timing means and arming the spring mechanism.

* * * * *